United States Patent [19]

Fukui et al.

[11] 4,399,024

[45] Aug. 16, 1983

[54] METHOD FOR TREATING PETROLEUM HEAVY OIL

[75] Inventors: Yukimasa Fukui; Heihachiro Mukaida, both of Yotsukaichishi; Masato Inden, Mieken, all of Japan

[73] Assignee: Daikyo Oil Company Ltd., Tokyo, Japan

[21] Appl. No.: 233,043

[22] Filed: Feb. 10, 1981

[30] Foreign Application Priority Data

Nov. 27, 1980 [JP] Japan ..... 55-167274

[51] Int. Cl.[3] ..... C10G 11/02

[52] U.S. Cl. ..... 208/131; 208/22; 208/23; 208/44; 208/114

[58] Field of Search ..... 208/106, 114, 120, 121, 208/7, 44, 48 AA, 22–23, 46, 50, 56, 52 R, 52 CT, 131, 132

[56] References Cited

U.S. PATENT DOCUMENTS 4,024,049 5/1977 Shell et al. ..... 208/48 AA
4,024,050 5/1977 Shell et al. ..... 208/48 AA
4,031,002 6/1977 McKay ..... 208/113
4,193,891 3/1980 McKay ..... 208/119 X
4,204,943 5/1980 Metrailer et al. ..... 208/50
4,269,696 5/1981 Metrailer ..... 208/50 X

FOREIGN PATENT DOCUMENTS 985180 3/1965 United Kingdom ..... 208/48 AA

*Primary Examiner*—Delbert E. Gantz
*Assistant Examiner*—G. E. Schmitkons
*Attorney, Agent, or Firm*—Armstrong, Nikaido, Marmelstein & Kubovcik

[57] ABSTRACT

A method is provided for producing cracked oil with a higher yield and coke having a higher fixed carbon content from petroleum heavy oil or tar sand bitumen or crude shale oil in a short time. This method is characterized by subjecting a petroleum heavy oil or tar sand bitumen or crude shale oil to heat treatment together with at least one additive selected from the group consisting of metal salts of dialkyldithiocarbamic acids, diaryldithiocarbamic acids, alkylxanthogenic acids, arylxanthogenic acids, dialkyldithiophosphoric acids, diaryldithiophosphoric acids, organic phosphoric acid esters, benzothiazoles and disulfides.

10 Claims, No Drawings

METHOD FOR TREATING PETROLEUM HEAVY OIL

BACKGROUND OF THE INVENTION

1. Field of the Invention

This invention relates to a method for producing coke by the thermal cracking of petroleum heavy oils e.g. atmospheric residue, vacuum residue, thermally cracked residue, catalytically cracked residue, solvent deasphalted residue, etc.

2. Description of the Prior Art

Current petroleum coke production employs the so-called delayed coker process, in which raw stock vacuum residue formed in a petroleum refining process is heated at about 450°~500° C. in a heating furnace and then sent to a coke drum to effect thermal cracking in the drum for a long period of time to produce coke. In this process, various improvements have heretofore been made and research works have been continued so as to obtain cracked oils with as high a yield as possible and to make the crystal of coke remaining in the drum as uniform as possible. Further, research works have been made also from the standpoint of energy saving to cope with the recent increase in the price of crude oil. For example, attempts have been made to increase reaction rate or shorten reaction time by using a catalyst, and to promote the growth of crystals of coke formed. As catalyst serving such purposes, there have heretofore been known Lewis acids such as $AlCl_3$, $FeCl_3$, $ZnCl_2$, $NiCl_2$, $SbCl_3$ and $BF_3$. But these catalysts have drawbacks in difficulties of handling and recovery of the catalyst, resulting in great increase of cost and hence have not been used in practical operation.

It has now been found that, in the coking of petroleum heavy oil by thermal cracking, when a solution of a metal salt of dithio acid such as zinc dialkyldithiocarbamate or zinc dialkyldithiophosphate is dissolved in a solvent of petroleum origin, adjusted to a suitable concentration, and continuously injected by an injection nozzle into the liquid or gas phase part within the coke drum at an extremely low feed rate such as $10^{-8}$ to $10^{-3}$ mol/hour per kg of a stock, the distillation-out of the cracked oil is promoted and the residue in the coke drum is quickly coked to give homogeneous coke having a higher fixed carbon content. The above-mentioned feed rate of the additive is in the most suitable range, but the process is operable even at feed rates outside the range. Thus it has been found that if an additive selected from the above-mentioned various kinds of metal salts of dithio acids, organic phosphates or benzothiazoles is added to the reaction system in a very small amount, a cracked oil can be obtained with a higher yield compared with those of the case where no additive is added, and homogeneous coke having a higher fixed carbon content can be obtained in a short period of time.

SUMMARY OF THE INVENTION

This invention resides in a method for treating petroleum heavy oil, such as, atmospheric residue, vacuum residue, thermally cracked residue, catalytically cracked residue, and solvent deasphalted residue, or tar sand bitumen or crude shale oil which comprises feeding said petroleum heavy oil or tar sand bitumen or crude shale oil into a coke drum together with at least one additive or feeding a petroleum heavy oil and separately therewith at least one additive into the gas phase or liquid phase of a drum, and subjecting said oil to heat-treatment at a temperature of 400° C. to 500° C. to produce cracked oil with a higher yield and also coke having a higher fixed carbon content in a short period of time, said additive being selected from the group consisting of metal salts of dialkyldithiocarbamic acids, diaryldithiocarbamic acids, alkylxanthogenic acids, arylxanthogenic acids, dialkyldithiophosphoric acid and diaryldithiophosphoric acids, organic esters of phosphoric acid, benzothiazoles and disulfides.

DETAILED DESCRIPTION OF THE PREFERRED EMBODIMENTS

Since the above-mentioned additives of the present invention have been used as an oxidation inhibitor for lubricating oils, it is believed that the performance of the additives is possibly due to their action in stabilizing the radicals formed as a result of the thermal cracking in the reaction system, which action promotes the rapid distillation of the resulting cracked oil to the outside of the system, without causing any secondary thermal cracking, and also to their action in hindering a plurality of radicals from recombining with each other to form high molecular substances, which action promotes the rapid distillation of the resulting cracked oil to the outside of the system, without being returned to the bottom of the reactor. Accordingly, it is believed that the saturated components of heavy oil are thermally cracked and distilled out rapidly by the addition of the above-mentioned additives in a small amount, and this makes the concentration of aromatic components in the residue higher, and promotes the polycondensation reaction to polycyclic aromatic compounds thereby to produce homogeneous coke having a higher fixed carbon content in a short period of time. Petroleum heavy oil used as a feed stock includes atmospheric residue, vacuum residue, thermally cracked residue, catalytically cracked residue, solvent deasphalted residue, tar sand bitumen, and crude shale oil.

The additives used in the present invention provide similar effectiveness either singly or in admixture of two or more additives. Also the alkyl and aryl substituent groups of the additives need not always be of the same kind. Even thio acid salts, organophosphoric acid esters, xanthogenic acid salts, thiazoles or disulfides, having polysubstituents consisting of different kinds of alkyl groups and/or aryl groups in an optional proportion thereof may be used.

These additives can be represented by general formulae in Table 1.

As described in the note of the general formulae of various kinds of additives, R includes straight or branched alkyl radicals having 1~18 carbon atoms, or phenyl radicals having straight or branched alkyl side chain of 1~18 carbon atoms. A metal such as zinc is used for M. Also, other metals such as sodium, potassium, nickel, tin, antimony, lead cadmium, molybdenum, tungsten, chromium, manganese, tellurium, bismuth, selenium, and the like are also useful.

To carry out coking of petroleum heavy oils by using such an additive, a temperature used in a coker of from 400° to 500° C. is generally preferable though thermal treatment conditions may vary depending upon the nature of stock oils and objective products. As the reaction pressure, atmospheric pressures will be sufficient, but coke with good quality can be obtained under a pressure of about 1~5 $Kg/cm^2G$. For adding the above-mentioned additive a procedure is used in which a solution of an additive diluted to an appropriate concentration in an aromatic solvent is continuously fed into a liquid or gas phase of reaction system by an injection nozzle. Alternatively, it is also possible to carry out thermal cracking after homogeneously dissolving an additive in a stock heavy oil in advance and send the resulting oil into a coke drum to carry out thermal cracking.

When coke is produced according to this method, greater parts of the additives are decomposed and hydrocarbon portions are distilled out of the system together with distilled oil. On the other hand, the metal remains in coke, but since the amount is so small compared with the total amount of the metal portion originally included in the stock oil that it does not matter. Further sulfur portion is discharged out of the system in the form of hydrogen sulfide.

The additives used in the method of the present invention are shown in Table 1.

TABLE 1

| | The additives used in the method of the present invention | | |
|---|---|---|---|
| | additives | general formula | note |
| 1 | salts of dialkyldithiophosphoric acid<br>salts of diaryldithiophosphoric acid | 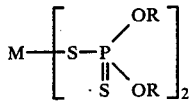 | M indicates a metal such as sodium, potassium, zinc, nickel, copper, antimony, tin, tellurium, lead, cadmium, bismuth, molybdenum, tungsten, selenium, chromium, manganese or the like. |
| 2 | salts of dialkyldithiocarbamic acid<br>salts of diaryldithiocarbamic acid | 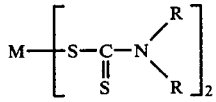 | R indicates a straight or branched alkyl radical of 1 ~ 18 carbon atoms or phenyl radical having alkyl side chain. |
| 3 | salts of alkylxanthogenic acid<br>salts of arylxanthogenic acid | 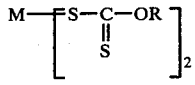 | |
| 4 | organic phosphoric acid esters | 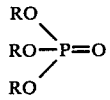 | |
| 5 | benzothiazoles | 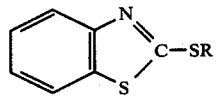 <br> 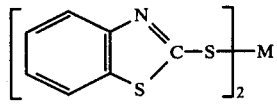 <br> 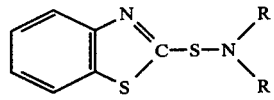 | |
| 6 | disulfides | 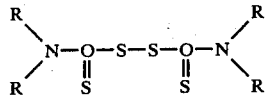 <br> 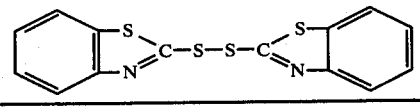 | |

The properties of the raw material oils used in the method of the present invention are indicated in Table 2.

TABLE 2

(Vacuum Residue = Residuum of Vacuum Distillation)

| | Vacuum Residue of Sumatra oil | Vacuum Residue of Murban oil | Vacuum Residue of Arabian light oil | Vacuum Residue of Gach Saran oil | Tar sand bitumen |
|---|---|---|---|---|---|
| Specific gravity (25/25° C.) | 0.9553 | 1.004 | 1.011 | 1.027 | 1.015 |
| Conradson carbon (% by weight) | 10.0 | 19.4 | 20.0 | 23.0 | 13.2 |
| Softening point (°C.) | — | 26 | 30 | 50 | — |
| Elemental analysis | | | | | |
| C (% by weight) | 87.1 | 84.9 | 85.3 | 83.9 | 83.8 |
| H (% by weight) | 12.4 | 10.8 | 10.6 | 10.0 | 10.4 |
| N (% by weight) | 0.4 | 0.3 | 0.3 | 0.7 | 0.4 |
| S (% by weight) | 0.2 | 2.4 | 4.4 | 3.9 | 4.9 |
| V (ppm) | 1 | 26 | 67 | 490 | 210 |
| Fe (ppm) | — | 29 | 9 | 24 | 190 |
| Ni (ppm) | 30 | 18 | 20 | 143 | 66 |

The following Examples and Comparative examples will further illustrate this invention.

EXAMPLE 1

Vacuum residue of Sumatra light oil in an amount of 850 g was charged in a stainless autoclave having an inner volume of 1.9 l. A rotary electromagnetic stirrer having a stirring blade extending down to the bottom of a retort was connected to the upper cover of the autoclave. A gas blowing tube was further led into the inside of the autoclave and nitrogen gas was blown into liquid phase therethrough at a flow rate of 0.6 l/min. The autoclave was heated externally by an electric furnace and the temperature was raised at a rate of 5° C./min. up to 430° C. and maintained at this constant temperature for 2 hours. During the heat treatment time, 1% by weight solution of zinc dialkyldithiocarbamate (alkyl group: $C_5H_{11}$, molecular weight: 529) in toluene was injected continuously from an additive injection port on the top cover through a microfeeder into the gas phase within the autoclave at a feed rate of $1.62\times10^{-4}$ mol/hr over 1.5 hr. During the heat treatment time, the heavy oil was thermally cracked, and cracked gas and cracked oil (boiling point: 550° C. or lower) were distilled out and at the same time carbonization of the residue proceeded. After the heat treatment carried out for 1.5 hours, distilling-out of cracked oil was hardly seen. After the heat treatment at 550° C. for additional one hour, the autoclave was forced to cool and quickly returned to room temperature.

The properties of stock oil are as shown in Table 2.

The yield of the product and the properties of coke are shown in Table 3 along with the data of Comparative examples described below.

The yield of cracked oil was 79.1% by weight which was 4.5% by weight higher than that of the Comparative example and the percent increase of the cracked oil was 6.3%.

The yields of coke and cracked gas of Example 1 were both smaller than those of Comparative example 1. Further the fixed carbon content of coke was higher than that of the Comparative example in spite of the shorter heat treatment time.

COMPARATIVE EXAMPLE 1

Eight hundred and fifty grams of vacuum residue of Sumatra light oil was charged into the autoclave used in Example 1. By using the same reaction apparatus, heat treatment was carried out at a temperature of 430° C. for 3 hours while blowing nitrogen gas at a flow rate of 0.8 l/min. and without injecting any of the additive. Further the temperature was further raised to 550° C. and heat treatment was carried out for one hour.

The yield of product and the properties of coke are shown in Table 3 below. The yield of cracked oil at this time was 74.6% by weight which was clearly lower than that of Example 1.

EXAMPLE 2

Eight hundred and fifty grams of vacuum residue of Murban oil was charged in an autoclave and subjected to heat treatment according to the same procedure as that of Example 1 while continuously injecting a 1% by weight solution of zinc dialkyldithiocarbamate (as used in Example 1) in toluene at a feed rate of $1.62\times10^{-4}$ mol/hr. to the gas phase within the autoclave. The properties of the stock oil are as shown in Table 2. The yield of product and properties of coke are shown in Table 3 described below.

The yield of the cracked oil at this time was 67.9% by weight which was 7.2% by weight higher than that of the following Comparative example 2 and the percent increase of cracked oil was 11.9%. The yields of coke and cracked gas were both lower than those of Comparative Example 2. The fixed carbon content of the coke was higher than that of the Comparative example in spite of the shorter heat treatment time.

COMPARATIVE EXAMPLE 2

Eight hundred and fifty grams of vacuum residue of Murban oil was charged into an autoclave and subjected to heat treatment at a temperature of 430° C. for 3 hours by using the same reaction apparatus as in Example 1 while blowing nitrogen gas into the reaction system at a flow rate of 0.8 l/min. The temperature was further raised up to 550° C. and heat treatment was continued for one hour. The yield of the product and the properties of coke are shown in Table 3.

The yield of cracked oil was 60.7% by weight which is clearly lower than that of Example 2 in which an additive was used.

EXAMPLE 3

Eight hundred and fifty grams of vacuum residue of Arabian light oil was charged in an autoclave and subjected to heat treatment according to the procedure same as that of Example 1 while continuously injecting a 1% by weight solution of zinc dialkyldithiocarbamate in toluene at a feed rate of $1.62\times10^{-4}$ mol/hr to the gas phase within the autoclave.

The properties of the stock oil are shown in Table 2 and the yield of the product and the properties of coke are shown in Table 3 described below.

The yield of the cracked oil at this time was 61.0% by weight which is higher than that of the following Comparative example by 5.6% by weight and the percentage increase of cracked oil was 10.1%.

The yields of coke and cracked gas of Example 3 were lower than those of Comparative example 3. The fixed carbon content of the coke showed values higher than those of the Comparative example in spite of the shorter heat treatment time.

COMPARATIVE EXAMPLE 3

Eight hundred and fifty grams of vacuum residue of Arabian light oil was charged into an autoclave and subjected to heat treatment at 430° C. for 3 hours by using the reaction apparatus same as that of Example 1, while blowing nitrogen gas at a flow rate of 0.8 l/min and without injecting an additive and the temperature was further elevated up to 550° C. followed by heat treatment for one hour. The yield of the product and the properties of coke are shown in Table 3 described below. The yield of the cracked oil at this time was 55.4% by weight which is clearly lower than that of Example 3 in which an additive was used.

EXAMPLE 4

Eight hundred and fifty grams of vacuum residue of Gach Saran oil was charged in an autoclave and subjected to heat treatment according to the procedure same as that of Example 1 while continuously injecting a 1% by weight solution of zinc dialkyldithiocarbamate in toluene (as used in Example 1) at a feed rate of $1.62\times10^{-4}$ mol/hr to the gas phase within the autoclave.

The properties of the stock oil is as shown in Table 2 and the yield of the product and the properties of coke are shown in Table 3 described below.

The yield of cracked oil at this time was 65.0% by weight which is higher than that of Comparative example 4 by 7.7% by weight and the percentage increase of the cracked oil was 13.4%.

The yields of coke and cracked gas of Example 4 were lower than those of Comparative example 4. The fixed carbon content of the coke showed values higher than those of Comparative example 4 in spite of the shorter heat treatment time.

COMPARATIVE EXAMPLE 4

Eight hundred and fifty grams of vacuum residue of Gach Saran oil was charged into an autoclave and subjected to heat treatment at a temperature of 430° C. for 3 hours by using the same reaction apparatus as that of Example 1, while blowing nitrogen gas at a flow rate of 0.8 l/min. and without injecting an additive. Further elevating the temperature up to 550° C., heat treatment was further continued for one hour. The yield of the product and the properties of coke are shown in Table 3 described below. The yield of the cracked oil at this time was 57.3% by weight which is clearly lower than that of Example 4 in which case an additive was used.

EXAMPLE 5

Eight hundred and fifty grams of vacuum residue of Murban oil was charged into an autoclave and subjected to heat treatment according to the same procedure as that of Example 1 by using the same reaction apparatus as that of Example 1.

The additive used in Example 5 was a 1% by weight solution of zinc dialkyldithiophosphate (alkyl group: $nC_8H_{17}$, molecular weight: 771) in toluene and this was injected continuously over 1.5 hours into the gas phase within the autoclave at a feed rate of $1.62\times10^{-4}$ mol/hr.

The properties of the stock oil were as shown in Table 2. The yield of the product and the properties of coke are shown in Table 3. The yield of cracked oil at this time was 68.2% by weight which is higher than that of Comparative example 2 by 7.5% by weight and the percent increase of cracked oil was 12.4%. Both the yields of coke and cracked gas in Example 5 were lower than those of Comparative example 2.

EXAMPLE 6

Eight hundred and fifty grams of vacuum residue of Murban oil was charged into an autoclave and subjected to heat treatment according to the same procedure as that of Example 1 by using the same reaction apparatus as that of Example 1.

The additive used in Example 6 was a 1% by weight solution of zinc dialkylxanthogenate (alkyl group: $C_2H_5$, molecular weight: 357) in ethanol and this was injected continuously over 1.5 hours into the gas phase part in the autoclave at a feed rate of $1.08\times10^{-3}$ mol/hr.

The properties of the stock oil was as shown in Table 2. The yield of the product and the properties of cokes are shown in Table 3. The yield of cracked oil at this time was 65.8% by weight which is higher than that of Comparative example 2 by 5.1% by weight and the percent increase of cracked oil was 8.4%. The yields of coke and cracked gas were both lower than those of Comparative example 2.

EXAMPLE 7

Eight hundred and fifty grams of vacuum residue of Murban oil was charged into an autoclave and subjected to heat treatment according to the same procedure as that of Example 1 by using the same reaction apparatus as that of Example 1. The additive used was a 2.6% by weight solution of trinonyl phosphate (molecular weight: 476) in toluene and this was injected continuously into the gas phase within the autoclave at a feed rate of $1.82\times10^{-3}$ mol/hr over 1.5 hours.

The properties of the stock oil were as shown in Table 2. The yield of the product and the properties of coke were as shown in Table 3. The yield of cracked oil at this time was 65.0% by weight which is higher than that of Comparative example 2 by 4.3% by weight and the percent increase of cracked oil was 7.1%. The yields of coke and cracked gas were both lower than those of Comparative example 2.

EXAMPLE 8

Eight hundred and fifty grams of vacuum residue of Murban oil was charged into an autoclave and subjected to heat treatment according to the same procedure as that of Example 1 by using the same reaction apparatus as that of Example 1. The additive used in Example 8 was a 2.3% by weight solution of benzothiazole (molecular weight: 135.2) in toluene and this was continuously charged into the gas phase within the autoclave at a feed rate of $5.45\times10^{-3}$ mol/hr over 1.5 hour.

The yield of the product and the properties of coke are shown in Table 3 described below. The yield of cracked oil at this time was 63.9% by weight which is higher than that of Example 2 by 3.2% by weight and the percent increase of cracked oil was 5.3%. The yields of coke and cracked gas of Example 8 were both lower than those of Comparative example 2.

EXAMPLE 9

Eight hundred and fifty grams of vacuum residuum of Murban oil was charged into an autoclave and subjected to heat treatment according to the same procedure as that of Example 1 and using the same reaction apparatus as that of Example 1.

The additive used was a 1% by weight solution of tetraethylthiuramdisulfide (molecular weight: 296.5, alkyl group: $C_2H_5$) in toluene and this was fed continuously over 1.5 hours into the gas phase within the autoclave at a feed rate of $1.30\times10^{-3}$ mol/hr. The yield of the product and the properties of the coke were as shown in Table 3 below. The yield of cracked oil at this time was 67.3% by weight which is higher than that of Comparative example 2 by 6.6% by weight. The percent increase of cracked oil was 10.9%.

EXAMPLE 10

Eight hundred and fifty grams of tar sand betumen was charged into an autoclave and subjected to heat treatment according to the procedure same with that of Example 1 while continuously injecting the 1% by weight solution of zinc dialkyldithiocarbamate in toluene used in Example 1 into the gas phase within the autoclave at a feed rate of $1.62\times10^{-4}$ mol/hr. The properties of the stock oil was as shown in Table 2. The yield of the product and the properties of coke are shown in Table 3 described below.

The yield of cracked oil at this time was 66.2% by weight which is higher than that of Comparative example 5 by 6.7% by weight and the percent increase of cracked oil was 11.3%. The yields of coke and cracked gas in Example 10 were both lower than those of Comparative example 5. The fixed carbon content of the coke showed a higher value in spite of the heat treatment time shorter than that of Comparative example 5.

COMPARATIVE EXAMPLE 5

Eight hundred and fifty grams of tar sand bitumen was charged in an autoclave and subjected to heat treatment at 430° C. for 3 hours by using the same reaction apparatus as that of Example 1 while blowing nitrogen gas at a flow rate of 0.8 l/min and without injection of the additive. After elevating the temperature up to 550° C., the heat treatment was continued for 1 hour.

The yield of the product and the properties of the coke are shown in Table 3 described below. The yield of cracked oil at this time was 59.5% by weight which is clearly lower than that of Example 10 in which case an additive was used.

TABLE 3

Result of coking of heavy oil

| | | Example 1 | Comparative example 1 | Example 2 | Comparative example 2 | Example 3 | Comparative example 3 | Example 4 | Comparative example 4 |
|---|---|---|---|---|---|---|---|---|---|
| condition of heat treatment | Stock oil | Vacuum residuum of Sumatra light | Vacuum residuum of Sumatra light | Vacuum Residuum of Murban | Vacuum Residuum of Murban | Vacuum Residuum of Arabian light | Vacuum Residuum of Arabian light | Vacuum Residuum of Gach Saran | Vacuum Residuum of Gach Saran |
| | Amount charged (g) | 850 | 850 | 850 | 850 | 850 | 850 | 850 | 850 |
| | Additive | zinc dialkyldi-thiocarbamate | — | zinc dialkyl-dithiocarbamate | — | zinc dialkyl-dithiocarbamate | — | zinc dialkyldi-thiocarbamate | — |
| | Feed rate of additive (mol/h) | $1.62 \times 10^{-4}$ | — | $1.62 \times 10^{-4}$ | — | $1.62 \times 10^{-4}$ | — | $1.62 \times 10^{-4}$ | — |
| | Time of feed of additive (hrs) | 1.5 | — | 1.5 | — | 1.5 | — | 1.5 | — |
| | Feeded position of additive | injection into gas phase | — | injection into gas phase | — | injection into gas phase | — | injection into gas phase | — |
| | Amount of blown-in $N_2$ gas (l/min) | 0.6 | 0.8 | 0.6 | 0.8 | 0.6 | 0.8 | 0.6 | 0.8 |
| | Condition of heat treatment | 430° C. × 1.5 hr + 550° C. × 1 hr | 430° C. × 3 hr + 550° C. × 1 hr | 430° C. × 1.5 hr + 550° C. × 1 hr | 430° C. × 3 hr + 550° C. × 1 hr | 430° C. × 1.5 hr + 550° C. × 1 hr | 430° C. × 3 hr + 550° C. × 1 hr | 430° C. × 1.5 hr + 550° C. × 1 hr | 460° C. × 3 hr + 550° C. × 1 hr |
| yield of product | Cracked oil (% by weight) | 79.1 | 74.6 | 67.9 | 60.7 | 61.0 | 55.4 | 65.0 | 57.3 |
| | Coke (% by weight) | 12.9 | 14.6 | 21.1 | 24.1 | 26.6 | 29.4 | 23.2 | 26.8 |
| | Gas + loss (% by weight) | 8.0 | 10.8 | 11.0 | 15.1 | 13.4 | 15.2 | 11.8 | 15.9 |
| | Difference* of yield of cracked oil (wt %) | 4.5 | — | 7.2 | — | 5.6 | — | 7.7 | — |
| | Percent increase of cracked oil** (%) | 6.0 | — | 11.9 | — | 10.1 | — | 13.4 | — |
| properties of coke | Industrial analysis | | | | | | | | |
| | Fixed carbon (% by weight) | 92.8 | 90.2 | 93.8 | 89.8 | 93.7 | 88.9 92.4 | 89.5 | |
| | Volatile matter (% by weight) | 7.1 | 9.8 | 6.1 | 10.2 | 6.2 | 11.0 | 7.4 | 10.4 |
| | Ash (% by weight) | 0.1 | 0.0 | 0.1 | 0.0 | 0.1 | 0.1 | 0.2 | 0.1 |
| | Sulfur (% by weight) | 0.65 | 0.79 | 5.68 | 5.47 | 6.71 | 6.27 | 4.32 | 4.55 |

| | | Example 5 | Example 6 | Example 7 | Example 8 | Example 9 | Example 10 | Comparative example 5 |
|---|---|---|---|---|---|---|---|---|
| condition of heat treatment | Stock | Vacuum Residuum of Murban | Vacuum Residuum of Murban | Vacuum Residuum of Murban | Vacuum Residuum of Murban | Vacuum Residuum of Murban | Tar sand bitumen | Tar sand bitumen |
| | Amount charged (g) | 850 | 850 | 850 | 850 | 850 | 850 | 850 |
| | Additive | zinc dialkyldi-thiophosphate | zinc alkyl-xanthogenate | trinonyl phosphate | benzothiazole | tetraethylthiuram disulfide | zinc dialkyl dithiocarbamate | — |
| | Feed rate of additive (mol/h) | $1.62 \times 10^{-4}$ | $1.08 \times 10^{-3}$ | $1.82 \times 10^{-3}$ | $5.45 \times 10^{-3}$ | $1.30 \times 10^{-3}$ | $1.62 \times 10^{-4}$ | |
| | Time of feed of additive (hrs) | 1.5 | 1.5 | 1.5 | 1.5 | 1.5 | 1.5 | |
| | Feeded position of additive | injection into gas phase | injection into gas phase | injection into gas phase | injection into gas phase | injection into gas phase | injection into gas phase | |
| | Amount of blown-in $N_2$ gas (l/min) | 0.6 | 0.6 | 0.6 | 0.6 | 0.6 | 0.6 | 0.8 |

TABLE 3-continued

| | | Result of coking of heavy oil | | | | | | |
|---|---|---|---|---|---|---|---|---|
| | Condition of heat treatment | 430° C. × 1.5 hr + 550° C. × 1 hr | 430° C. × 1.5 hr + 550° C. × 1 hr | 430° C. × 1.5 hr + 550° C. × 1 hr | 430° C. × 1.5 hr + 550° C. × 1 hr | 430° C. × 1.5 hr + 550° C. × 1 hr | 430° C. × 1.5 hr + 550° C. × 1 hr | 430° C. × 3 hr + 550° C. × 1 hr |
| yield of product | Cracked oil (% by weight) | 68.2 | 65.8 | 65.0 | 64.9 | 67.3 | 72.1 | 69.5 |
| | Coke (% by weight) | 20.8 | 23.7 | 22.6 | 23.0 | 21.5 | 20.5 | 22.0 |
| | Gas + loss (% by weight) | 11.0 | 10.5 | 12.4 | 12.1 | 11.2 | 7.4 | 8.5 |
| | Difference* of yield of cracked oil (wt. %) | 7.5 | 5.1 | 4.3 | 3.2 | 6.6 | 2.6 | — |
| | Percent increase of cracked oil** (%) | 12.4 | 8.4 | 7.1 | 5.3 | 10.9 | 3.7 | — |
| properties of coke | Industrial analysis | | | | | | | |
| | Fixed carbon (% by weight) | 93.5 | 90.2 | 90.4 | 91.7 | 92.2 | 93.6 | 88.5 |
| | Volatile matter (% by weight) | 6.4 | 9.7 | 9.6 | 8.3 | 7.8 | 6.3 | 11.4 |
| | Ash (% by weight) | 0.1 | 0.1 | 0.0 | 0.0 | 0.0 | 0.1 | 0.1 |
| | Sulfur (% by weight) | 5.54 | 5.48 | 5.43 | 5.61 | 5.51 | — | — |

*yield of cracked oil of Example minus yield of cracked oil of Comparative example
**difference in cracked oil yield/cracked oil yield of Comparative example × 100

What is claimed is:

1. A method for producing cracked oil and homogeneous coke of higher fixed carbon with a higher yield by treating petroleum heavy oil selected from the group consisting of atmospheric residue, vacuum residue, thermally-cracked residue, catalytically cracked residue, solvent deasphalted residue, tar sand bitumen and crude shale oil, which comprises subjecting said petroleum heavy oil to heat treatment at a temperature of 400°–550° C. by continuously feeding an additive selected from the group consisting of zinc, nickel, tin, lead, cadmium, tungsten and molybdenum salts of dialkyldithiocarbamic acid, diaryldithiocarbamic acid, alkylxanthogenic acid and arylxanthogenic acid to said petroleum heavy oil.

2. A method for producing cracked oil and coke by treating petroleum heavy oil according to claim 1 in which feeding of said additive is carried out by injection through an injection nozzle to vapor phase within a coke drum.

3. A method for producing cracked oil and coke by treating petroleum heavy oil according to claim 1 in which feeding of said additive is carried out by injection through an injection nozzle to the liquid phase within a coke drum.

4. A method for producing cracked oil and coke by treating petroleum heavy oil according to claim 1 in which feeding of said additive is carried out together with said petroleum heavy oil.

5. A method for producing cracked oil and coke by treating petroleum heavy oil according to claim 1 in which said additive is used alone.

6. A method for producing cracked oil and coke by treating petroleum heavy oil according to claim 1 in which said additive is used as a mixture of different kinds of additives.

7. A method for producing cracked oil and coke by treating petroleum heavy oil according to claim 1 in which an aryl component of said additive is a phenyl group substituted with a straight or branched alkyl group of 1–18 carbon atoms.

8. A method for producing cracked oil and coke by treating petroleum heavy oil according to claim 1 in which an alkyl component of said additive is straight or branched alkyl group of 1–18 carbon atoms.

9. A method for producing cracked oil and homogeneous coke of higher fixed carbon with a higher yield by treating petroleum heavy oil selected from the group consisting of atmospheric residue, a vacuum residue, thermally-cracked residue, catalytically cracked residue, solvent deasphalted residue, tar sand bitumen and crude shale oil, which comprises subjecting said petroleum heavy oil to heat treatment at a temperature of 400°–550° C. by continuously feeding an additive selected from the group consisting of disulfides, benzothiazoles or metal salts thereof, metal salts of alkylxanthogenic acids, metal salts of arylxanthogenic acids, metal salts excluding antimony of dialkyldithiocarbamic acids, metal salts excluding antimony of diaryldithiocarbamic acids, metal salts excluding antimony of dialkyldithiophosphoric acids and metal salts excluding antimony of diaryldithiophosphoric acid to said petroleum heavy oil.

10. A method for producing cracked oil and coke by treating petroleum heavy oil, tar sand bitumen or crude shale oil according to claim 9 in which the metal component of said benzothiazole, alkylxanthogenic acid and arylxanthogenic acid is zinc, sodium, potassium, nickel, antimony, lead, cadmium, molybdenum, tungsten, chromium, manganese, tellurium, bismuth or selenium.

* * * * *